US008573367B2

(12) United States Patent
Henseler

(10) Patent No.: US 8,573,367 B2
(45) Date of Patent: Nov. 5, 2013

(54) ELEVATOR CAR FOR REDUCED UPPER ENDS OF ELEVATOR SHAFTS

(75) Inventor: Markus Henseler, Immensee (CH)

(73) Assignee: Inventio AG, Hergiswil (CH)

( * ) Notice: Subject to any disclaimer, the term of this patent is extended or adjusted under 35 U.S.C. 154(b) by 798 days.

(21) Appl. No.: 12/677,667

(22) PCT Filed: Sep. 5, 2008

(86) PCT No.: PCT/CH2008/000372

§ 371 (c)(1),
(2), (4) Date: Mar. 11, 2010

(87) PCT Pub. No.: WO2009/036583

PCT Pub. Date: Mar. 26, 2009

(65) Prior Publication Data

US 2010/0200339 A1 Aug. 12, 2010

(30) Foreign Application Priority Data

Sep. 17, 2007 (CH) ..... 1445/07

(51) Int. Cl.
*B66B 5/00* (2006.01)

(52) U.S. Cl.
USPC ..... 187/401

(58) Field of Classification Search
USPC ..... 187/276, 401
See application file for complete search history.

(56) References Cited

U.S. PATENT DOCUMENTS

| | | | | |
|---|---|---|---|---|
| 6,202,800 | B1 * | 3/2001 | Muller et al. | 187/401 |
| 6,202,801 | B1 * | 3/2001 | Muller et al. | 187/401 |
| 6,209,686 | B1 * | 4/2001 | Tomasetti et al. | 187/401 |
| 6,419,052 | B1 * | 7/2002 | Muller et al. | 187/414 |
| 6,691,833 | B1 * | 2/2004 | Elsener et al. | 187/266 |
| 6,739,432 | B2 * | 5/2004 | Elsener | 187/401 |
| 6,880,678 | B1 * | 4/2005 | Schneider et al. | 187/314 |
| 7,337,880 | B2 * | 3/2008 | Sittler | 187/401 |
| 7,523,809 | B2 * | 4/2009 | Monzon-Simon et al. | 187/401 |
| 8,316,998 | B2 * | 11/2012 | Henseler | 187/401 |
| 2003/0015378 | A1 * | 1/2003 | Elsener | 187/336 |

FOREIGN PATENT DOCUMENTS

| | | | | | |
|---|---|---|---|---|---|
| DE | 959758 | C | | 3/1957 | |
| DE | 10104351 | A1 | * | 8/2002 | B66B 11/02 |
| EP | 1333000 | | * | 8/2003 | B66B 11/02 |
| EP | 1333000 | A | | 8/2003 | |
| JP | 08268669 | A | | 10/1996 | |
| JP | 2002020062 | | * | 1/2002 | B66B 11/02 |
| JP | 2002020062 | A | | 1/2002 | |
| WO | WO 2005105645 | | * | 11/2005 | B66B 11/02 |
| WO | WO2008074168 | A | | 6/2008 | |
| WO | WO2008095324 | A | | 8/2008 | |

* cited by examiner

*Primary Examiner* — William A Rivera
*Assistant Examiner* — Michael Riegelman
(74) *Attorney, Agent, or Firm* — CUSPA Technology Law Associates; Yi Li

(57) ABSTRACT

This elevator car (10) is characterized by a car roof (9), which is designed to be non-load bearing, so that in the uppermost position of the car (10) the required free space F in the form of a cuboid lying on one of the sides thereof and having the minimum dimensions of 0.5 m×0.6 m×0.8 m is located completely inside the car (10) and extends down to the car floor (8). When a potential load is applied onto the car roof (9), it yields or is lowered due to deformation. In this way, the required free space F of 0.6 m×0.5 m×0.8 m above the surface on which a maintenance technician can stand is ensured in any case as a safety space against the danger of crushing, even if the elevator car moves very close to the ceiling of the shaft.

12 Claims, 3 Drawing Sheets

Prior Art

Prior Art

ELEVATOR CAR FOR REDUCED UPPER ENDS OF ELEVATOR SHAFTS

Figure 1:
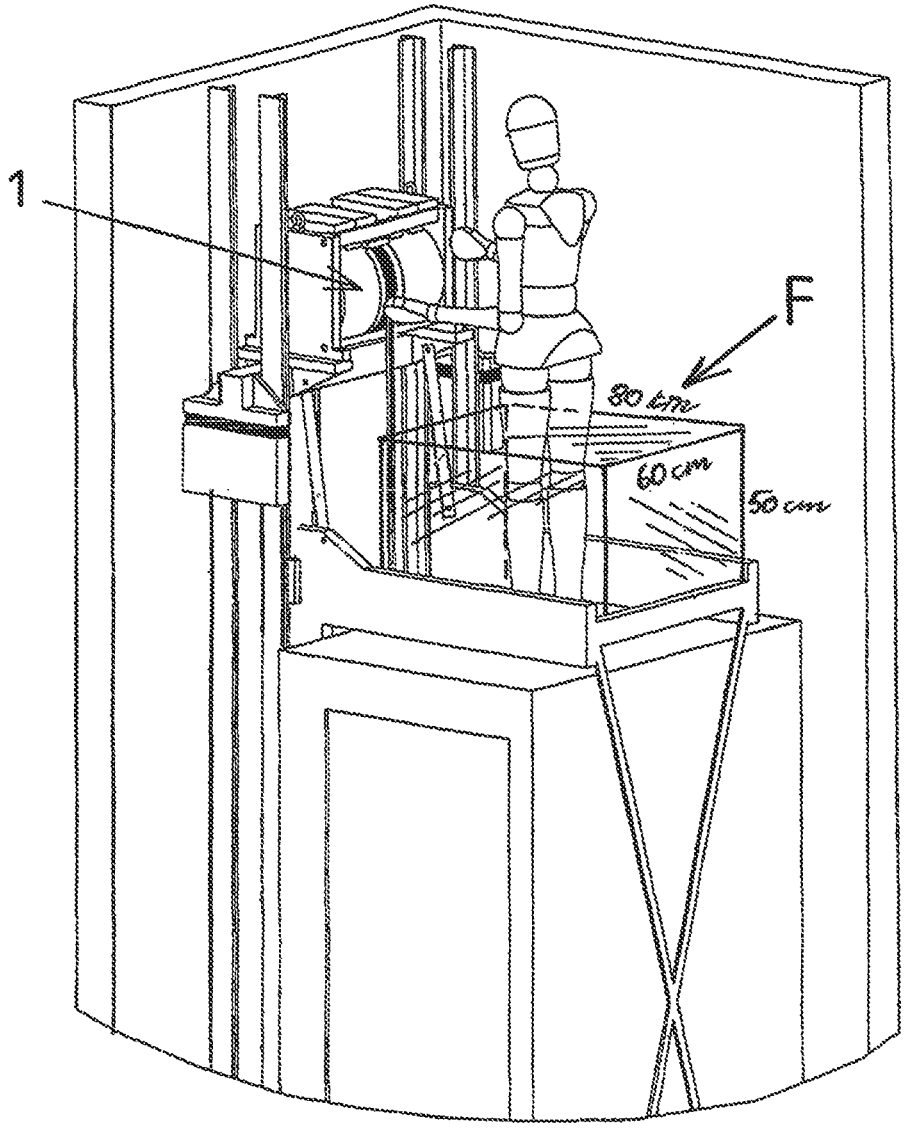

The present invention relates to an elevator car for reduced elevator shaft tops. Conventionally, several elevator drives are disposed in the upper end of the elevator shaft. In order to perform maintenance on these elevator drives, an elevator technician must climb onto the roof of the elevator car in order to gain access to the elevator drive. This is generally dangerous, and in the past a number of lift technicians sustained injuries when performing such control and maintenance work between the elevator car and shaft top, or were even killed as a result of being crushed. As a result, legislators have passed strict guidelines which are intended to make crushing impossible.

According to a key regulation, new elevators must prevent the danger of crushing in the end positions of the elevator car through free spaces and/or protective areas. Based on the wording of clause 2.2 in the Elevator Ordinance and the EU Directive on Lifts, this means that for legislators optimum safety is achieved by a mandatory specified protective space. The shaft top, the pit, and the protective space are defined by the harmonized standards SN EN-1/2:1998. According to section 5.7.1, the following is specified under d) with respect to the upper protective space of friction driven elevators: The space over the car must be able to receive a cuboid lying on one of the sides thereof and measuring a minimum of 0.5 m×0.6 m×0.8 m, more specifically permanently. Additional free space may be created temporarily as long as it is ensured that the elevator shaft can only be accessed if this free space is created. The height of this additional free space having a base area of 0.48 m×0.25 m depends on the maximum speed of the elevator car and is calculated in meters as $1+0.035\times v^2$, where v is used as [m/s]. These regulations are in effect and must also be adhered to if it is not necessary to climb on the car roof in order to maintain the elevator.

Previously, however, it has hardly been necessary to avoid stepping onto the elevator car (car roof). The majority of elevator drives are located at the upper end of the elevator shaft top and, as a result, the elevator car (car roof) must be load-bearing in order to perform the maintenance work. The situation is different for an elevator design in which the upper end of the shaft top remains completely clear. In the architectural world, there is an increasing desire to be able to forego unaesthetic elevator shaft tops on buildings. However, this poses new challenges for elevator manufacturers, because each design at the same time must comply with the applicable elevator ordinances. The latest elevator designs allow a minimum shaft top height of merely 280 cm. This is the dimension from the floor of the top building story to the bottom of the elevator shaft top, which is to say to the ceiling of the elevator shaft. An elevator to be installed there, for example, comprises a car having an inside height of 220 cm. Approximately 10 cm is required for overtravel at the top above the car. Additional height is required for the elevator door drive. As a result, the remaining space is 50 cm in the uppermost normal elevator position. This space is required as a safety buffer. When the elevator carrying a heavy load stops on the top building story, precisely at the level of the floor, and the load is then reduced, the car may be lifted by another several centimeters due to the elasticity of the support cables. Even then, a gap must remain to the top of the elevator shaft so that the elevator car under no circumstances can knock against the top. This configuration having an elevator car height of 220 cm, plus the minimum height of the lying cuboid of 0.50 m, which is 220 cm+50 cm+10 cm overtravel, results in precisely this shaft top height of 280 cm. There is a desire to reduce this dimension of the shaft top even further, as the common story height in residential buildings is 240 cm. On top of that, there is the concrete ceiling and perhaps a flat roof design. Elevator shaft tops measuring 280 cm above the uppermost story floor in many cases are still higher than the particular roof design, so that the elevator top still protrudes from the roof. This is precisely what is supposed to be avoided.

It is therefore the object of the present invention to create an elevator car for reduced elevator shaft tops, which requires a minimal shaft top height for a specific elevator car height and yet is able to comply with the elevator ordinance regulations with respect to the free spaces in order to prevent the danger of crushing.

This object is achieved by an elevator car for reduced elevator shaft tops which remains free of drive elements above the elevator car cross-section, the elevator car being characterized in that the car roof is designed to be non-load bearing, so that in the uppermost position of the car the required free space in the form of a cuboid lying on one of the sides thereof and having the minimum dimensions of 0.5 m×0.6 m×0.8 m is located completely inside the car and extends down to the car floor.

The drawings explain the principle, which will be described hereinafter based on the same.

Figure 2:
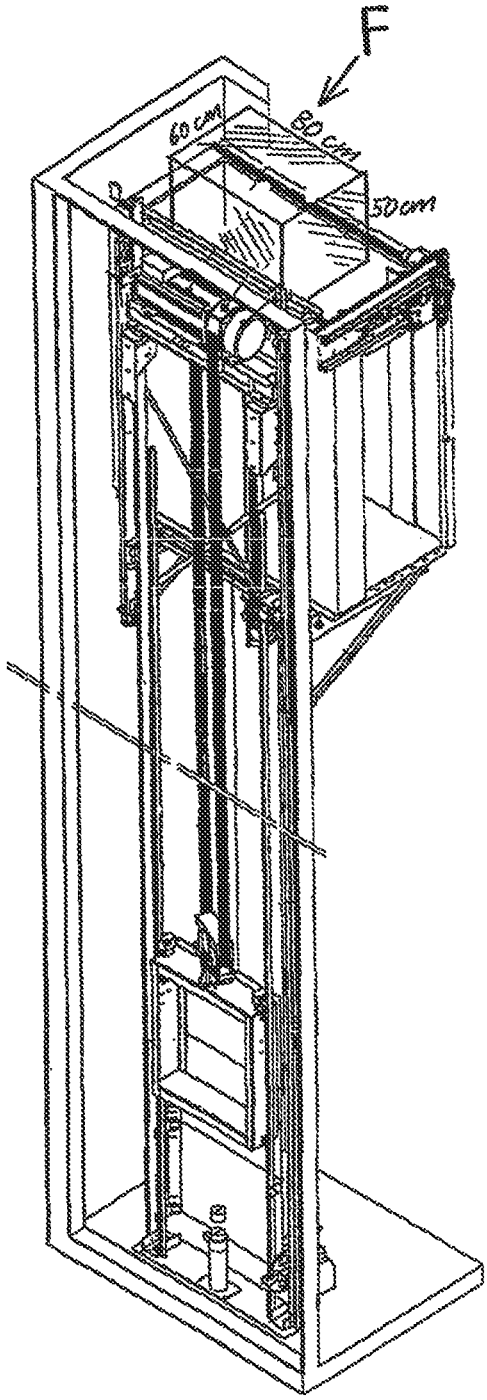
Figure 3:
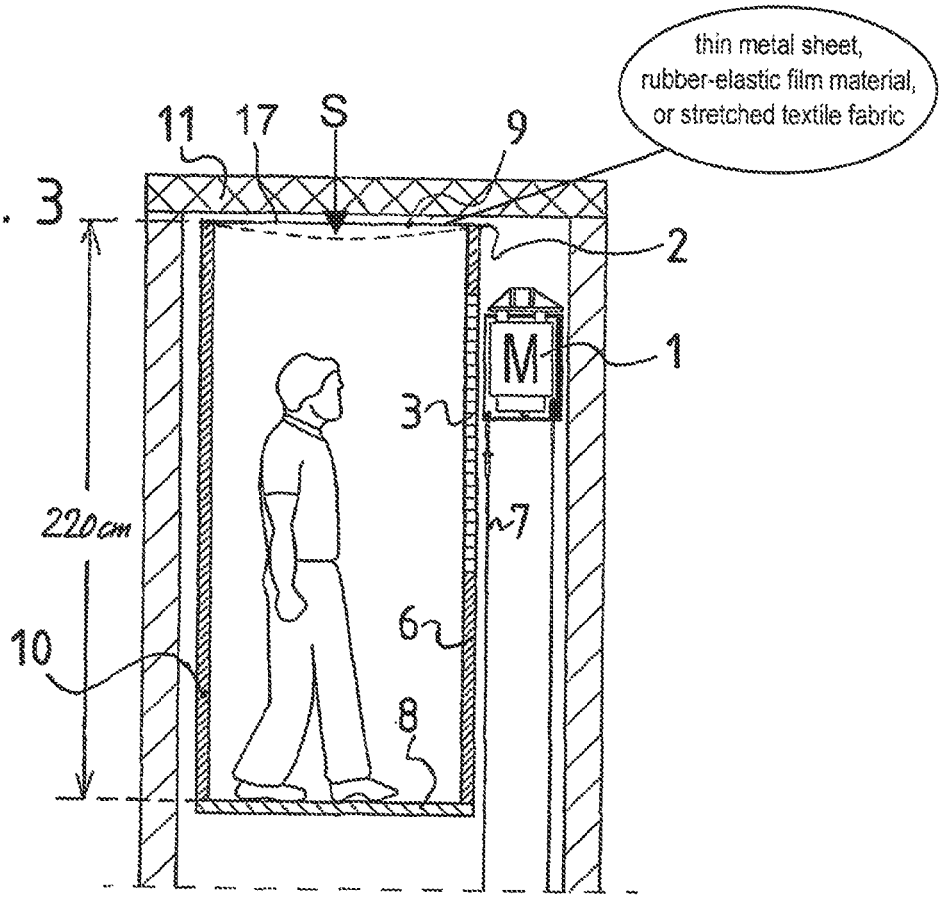
Figure 4:
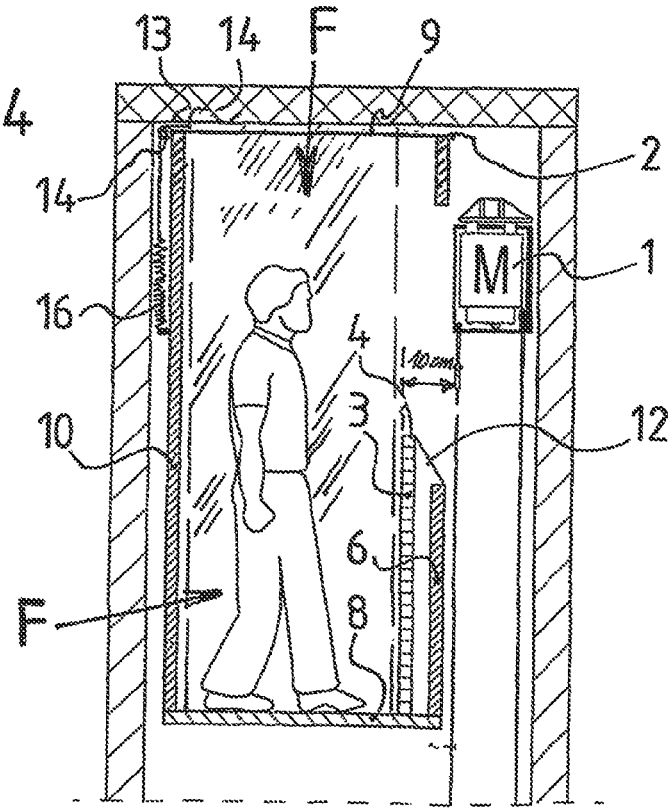

Shown are:

FIG. 1: shows an elevator shaft top with the elevator car being in the highest position, comprising a conventional elevator drive, while maintenance work is being performed on the elevator motor, and the stipulated free space F above the car being shown as protection against the danger of crushing;

FIG. 2: shows an elevator shaft with the elevator car being in the highest position, comprising a lower lying elevator motor, and the stipulated free space F above the car being shown as protection against the danger of crushing;

FIG. 3: shows an elevator shaft top with the elevator car being in the highest position, wherein the elevator car overtravels the laterally disposed elevator motor, thereby allowing maintenance work to be conducted from inside the elevator car; and FIG. 4: shows an elevator shaft top with the elevator car being in the highest position, wherein the elevator car overtravels the laterally disposed elevator motor, with the maintenance window being open for carrying out maintenance work from inside the elevator car, and the functional free space F being shown.

As is apparent from FIG. 1, in such a conventional arrangement of the elevator motor it is essential that the maintenance work is performed from the car top. For this purpose, the elevator technician stands on the car roof. A free space F measuring 0.5 m×0.6 m×0.8 m must always be present, for example as shown in the drawing, on such a car roof, which is to say above the surface on which the elevator technician stands. The cuboid measuring 0.5 m×0.6 m×0.8 m, however, may also lie on a different side. Even if the elevator motor and all other drive elements were disposed at the bottom of the elevator shaft, the free space would have to be provided, because it is conceivable that someone would step on the car roof. Even then, it would therefore not be possible to move the elevator car with the car roof thereof entirely to the end of the elevator shaft top.

FIG. 2 shows a different conventional elevator design. In this design, the elevator motor is disposed further down, not directly above the cross-section of the elevator car, but approximately at the level of the upper car edge, when the car is in the uppermost position thereof, as is shown here. However, the elevator motor must always be maintained from the outside—it is never accessible from inside the car. Again, a free space F measuring 0.5 m×0.6 m×0.8 m must always be present on the car roof, wherein this space may be provided, for example, as illustrated. The 0.5 m×0.6 m×0.8 m cuboid, however, can again lie on a different side.

The conditions of the embodiment according to FIG. 3 are quite different, which shows an elevator car for reduced elevator shaft tops according to the invention. Here, the elevator car, once it has reached the uppermost position as shown, has completely overtraveled the laterally disposed elevator motor 1 with the upper outer edge 2 thereof, so that the elevator motor 1 is located next to the elevator car 10. The dimensional situation here is significantly different. At an elevator car height of 220 cm, this car 10 can travel almost to the upper end of the elevator shaft top 11. The only aspect requiring consideration is the height of approximately 15 to 20 cm for installing the door drives for the elevator doors, and also a buffer zone of a few centimeters in the event that the elevator car is lifted by a few centimeters due to the elasticity of the support cables as a result of the weight being reduced when people exit. In any case and regardless of the above, however, the condition that must always be met is that a free space F measuring 0.5 m×0.6 m×0.8 m above the car 10, or the surface onto which a technician can step, is preserved, even if an elevator technician will never have to climb onto the roof of this elevator car 10. The requirement of this free space F is met because the ceiling 9 of the elevator car 10 is designed in a non-load bearing manner. For this purpose, the elevator car roof is designed such that nobody would consider stepping on it, because it is quite obvious from the design that it does not support any loads. For example, the car roof may be composed merely of a metal sheet, which inevitably will deform if anyone should step on it and sags downward, (as indicated by arrow S in F*ig*. 3), so that it is apparent to everyone immediately that this is not right because the car roof is not designed to be stepped on. In addition, extremely clear information signs (17) are attached everywhere, even on the car roof, thereby excluding that someone will step on it. Similarly, the car roof could also be composed of a stretched plastic film made of transparent or translucent film material. In another variant, the car roof may be produced by a stretched textile fabric. In any case, the roof is designed such that everyone immediately recognizes that one cannot step on it due to a lack of load bearing capacity. Yet, if someone were to step on the roof, the roof would immediately yield slightly, while still ensuring that a person would not fall into the car. However, there is no reason to even want to step on the car roof, in fact the roof could even be dispensed with entirely, thereby creating a car that is open at the top, which however may not be desirable, but technically amounts to the same concept that is supposed to be illustrated here.

In such a roof design of the car which is not load-bearing a priori, when the elevator car is in the highest position conceivable in the elevator shaft, the free space F is located entirely inside the cabin, but still above the car within the meaning of a surface on which the maintenance technician would stand, or above the uppermost conceivable surface on the car for a person to stand at all. In this way, the free space F in any case extends at least over the entire interior car height, which is at least 200 cm or more. The base area of the free space F, or the side area of the required cuboid resting on the area on which someone can stand, in any case measures at least 0.5 m×0.6 m, but typically significantly more because this base area in terms of the dimensions thereof corresponds almost the floor of the car, which is always larger than 0.5 m×0.6 m.

A human body can never be located "on" the car roof because it does not support loads, but would immediately yield and become deformed. However, these are theoretical considerations, which are not relevant in practical applications, because no one will ever step on the car, for the same reason that no one would ever step on the roof of a glasshouse or greenhouse. FIG. 4 shows how the maintenance work can be performed on this elevator design. For this purpose, part 3 of the side wall of the car 10 is removed toward the inside of the car 10 and placed in front of the lower part 6 of the side wall. This removable side wall part 3 is placed in front of the lower side wall part 6 at a certain distance. The distance is maintained by a spacer 12 or by a hand rail at the lower side wall part 6. As is apparent from FIGS. 3 and 4, the support cables 7 run very close past the elevator car 10, because the intent is to keep the depth of the drive apparatus as small as possible so as not to waste unnecessary space in the elevator shaft at the expense of the car width. One regulation stipulates that the distance from the parapet 4, on which the elevator technician is working, to the movable parts to be maintained and controlled is at least 10 cm. By disposing the upper side wall part 3 at a distance, it is ensured that this distance of 10 cm to the closest moving parts, which is to say the support cables, but also to the guide rails on which the car is moved past for maintenance purposes, is maintained. The regulation relating to the free space F of 0.5 m×0.6 m×0.8 m above the car 10, or above the surface onto which a technician can step, is therefore met, because this free space F under the conditions shown here with the non-load bearing car roof as shown extends down to the floor of the car.

In a first variant, the non-load bearing roof 9 of the elevator car 10 can be made of a mere sheet metal, as is shown in FIGS. 3 and 4. As soon as a load is placed on the roof, the metal sheet bends and a large, downwardly directed dent is produced. In addition, the non-load bearing roof part may be composed of film material, for example rubber-elastic film material, which is either made of plastic or a textile fabric. Finally, it can also be designed as a rigid plate, which is attached to cables, which can be extended in a spring-loaded manner, for example. This can be implemented, for example, as shown in FIG. 4, which is to say that the corners of the roof part are suspended from cable pulls 13, which are guided along the outside of the elevator car over deflection rollers 14 and are attached there to tension springs 16. Of course other guides of the steel cable pulls are conceivable, so that they run merely on the car roof. As soon as the spring forces are exceeded by a load on the roof, the roof 9 lowers downward due to the elongation of the springs 16, at least so far that the required free space F is available.

These optionally different measures in any case provide the required free space F, although from a technical point of view it would no longer be required. However, in this way, compliance with the regulations is ensured, and it allows the construction of elevator systems having significantly reduced elevator shaft top heights. In practical experience, minimum heights of the elevator car top of 255 cm can still be achieved with car interior heights of 220 cm. This difference of 45 cm is required for the car design, and in particular for the motor drives for the elevator doors as well as a buffer zone. In the case of even more compact electric motors for door drives, the shaft top height can be reduced by another few centimeters, for example to approximately 240 cm.

The invention claimed is:

1. An elevator car for reduced elevator shaft tops that remain free of drive elements above a cross-section of the elevator car, said elevator car (10) comprising a car floor (8), side walls perpendicular to the car floor, and on an upper end (2) of the side walls of the elevator car attached a non-load bearing car roof (9) that deforms downward or descends immediately into an interior of the elevator car in response to stepping thereon by a person, said elevator car having a free space (F), in a form of a cuboid having a minimum dimension of 0.5 m×0.6 m×0.8 m over a surface on which a maintenance worker stands to perform maintenance, located completely inside the elevator car (10); and said elevator car having a removable upper side wall part (3) on one of the side walls of the elevator car, adapted to be removed from inside of the elevator car to form a maintenance window for the maintenance worker standing on the car floor (8) to perform maintenance therethrough, wherein said surface is the car floor (8).

2. The elevator car according to claim 1, wherein the non-load bearing car roof (9) is made of a thin metal sheet that deforms downward immediately in response to the person stepping thereon.

3. The elevator car according to claim 1, wherein the non-load bearing car roof (9) is made of a rubber-elastic film material that deforms downward immediately in response to the person stepping thereon.

4. The elevator car according to claim 1, wherein the non-load bearing car roof (9) is made of a stretched textile fabric that deforms downward immediately in response to the person stepping thereon.

5. The elevator car according to claim 1, wherein the non-load bearing car roof (9) is formed by a plate held by spring-loaded cables at the upper end (2) of the side walls of the elevator car (10), and the plate descends immediately, in a spring-loaded manner, into the interior of the elevator car in response to the person stepping thereon.

6. The elevator car according to claim 5, wherein the plate is suspended from spring-loaded cable pulls (13) that are attached to tension springs (16) and guided over deflection rollers (14).

7. The elevator car according to claim 6, wherein the tension springs (16) are attached to an outside of the side walls of the elevator car (10).

8. The elevator car according to claim 5, wherein the plate is adapted to descend into the interior of the elevator car to an extent that a space of said cuboid becomes available thereon.

9. The elevator car according to claim 1, wherein the elevator car further comprises an information sign attached on the car roof or other parts of the elevator car to prevent the person from stepping on the non-load bearing car roof.

10. The elevator car according to claim 1, wherein a reduced elevator shaft top height, from a floor of an uppermost floor of a building to a ceiling of an elevator shaft, is 255 cm, when an interior height of the elevator car (10) is 220 cm.

11. The elevator car according to claim 1, wherein a reduced elevator shaft top height, from a floor of an uppermost floor of a building to a ceiling of an elevator shaft, is approximately 240 cm, when an interior height of the elevator car (10) is 220 cm.

12. The elevator car according to claim 1, wherein at a highest position in the reduced elevator shaft top, the upper end (2) of the side walls of the elevator car (10) overtravels a laterally disposed elevator motor, thereby allowing the maintenance to be conducted from inside of the elevator car through the maintenance window on one of the side walls.

* * * * *